United States Patent [19]

Sherman

[11] 4,079,884

[45] Mar. 21, 1978

[54] ENERGY-CONSERVING FLUE DAMPER

[76] Inventor: Gerald Michael Sherman, 7601 Hwy. 42, Florence, Ky. 41042

[21] Appl. No.: 707,307

[22] Filed: Jul. 21, 1976

[51] Int. Cl.[2] ..... F23N 3/00

[52] U.S. Cl. ..... 236/1 G; 431/20

[58] Field of Search ..... 431/20; 236/1 G; 126/285 B

[56] References Cited

U.S. PATENT DOCUMENTS

| | | | |
|---|---|---|---|
| 2,154,644 | 4/1939 | Sweatt | 431/20 |
| 2,224,705 | 12/1940 | Stringer | 431/20 X |
| 2,508,885 | 5/1950 | MacKay | 431/20 |
| 3,010,451 | 11/1961 | Hodgins | 431/20 X |
| 3,090,558 | 5/1963 | Vaughn | 236/1 G |
| 3,934,796 | 1/1976 | Smith, Jr. et al. | 431/20 X |

*Primary Examiner*—William E. Wayner
*Assistant Examiner*—William E. Tapolcai, Jr.
*Attorney, Agent, or Firm*—Thomas M. Farrell

[57] ABSTRACT

A flue damper to control the exhaust flow in a flue, wherein a flue damper plate is movable from an open position to a closed position by a solenoid operated plunger and returned from the closed position to the open position by a biasing spring. A damper arm actuates a normally-open limit switch closing the limit switch contacts. The limit switch is in series with normally open contacts of a thermostat, fuel valve, and power source, establishing a fuel system circuit. When the damper plate is in the closed position, the limit switch contacts are open and the fuel system circuit is broken. The plunger solenoid is connected in series with normally closed contacts of the thermostat, and power source, establishing an electrical circuit to close the damper plate. Thus, the circuit to close the damper plate and the fuel system circuit are mutually exclusive so that fuel may not be fired within the flue when the damper plate is closed.

2 Claims, 2 Drawing Figures

ENERGY-CONSERVING FLUE DAMPER

BACKGROUND OF THE INVENTION

In fuel fired heating systems, it is usually necessary and desirable to provide a flue to conduct hot exhaust products from the heating appliance to be expelled through a chimney. However, when the fuel system is not fired, the flue may also act as a conduit for the flow of heated air from the environs, providing a ready escape for energy.

Applicant has identified the flue as a conduit for the loss of energy, and has discovered that if properly dampered off during the periods of time when the system is not actually fired, a savings in energy may be realized by inhibiting the conduction of heated air from the environs.

In some systems, such as an oil-fired heating appliance, spark ignition may be used when firing the unit and, therefore, there are no pilot systems to vent. However, in a gas-fired appliance, which often does not employ spark ignition but rather relies on a pilot flame for ignition, it is preferable to vent the pilot products of combustion through the flue. Therefore, as a means of venting the pilot products of combustion, and as a means of inducing a chimney effect in the flue to a degree, applicant has discovered that it is preferable not to completely obstruct the flue passageway, but rather to have predetermined clearance in the exhaust flow path which may be achieved by several ways. For example: clearance between the periphery of the damper plate and the wall of the flue, or by orifices through the closed damper plate.

It is therefore an object of the present invention to provide an energy-conserving flue damper which will control the exhaust flow of a flue between the on-off cycles of a fuel-fired heating system.

Another object of the present invention is to provide mutually exclusive circuits for the fuel supply system and the damper powering elements.

A still further object of the present invention is to provide predetermined clearances in the exhaust flow path of a dampered-off flue.

SUMMARY OF THE INVENTION

The invention is shown embodied in a damper system having a movable damper plate within a flue wherein the damper plate is moved from an "open" position to a "closed" position by means of a solenoid-operated plunger, and returned to the "open" position by a biasing spring force. A transverse damper arm contacts a limit switch in the "open" position, holding the normally-open contacts within the limit switch closed; the limit switch contacts being in series circuit with a pair of normally-open thermostat contacts, fuel control means and power source.

The solenoid is in series circuit with normally-closed contacts of a thermostat and power source.

The fuel system circuit and the damper closing circuit are mutually exclusive, so that the fuel system circuit may inhibit the supply of fuel when the damper is "closed," and is designed to promote the flow of fuel when the damper is "open."

Predetermined clearances are provided in the exhaust flow path so that the flow path is not completely obstructed when the damper is in the "closed" position; thus providing the capabilities to vent a pilot flame system and to induce a "chimney effect" in the flue.

DESCRIPTION OF THE PREFERRED EMBODIMENT

Figure 1:
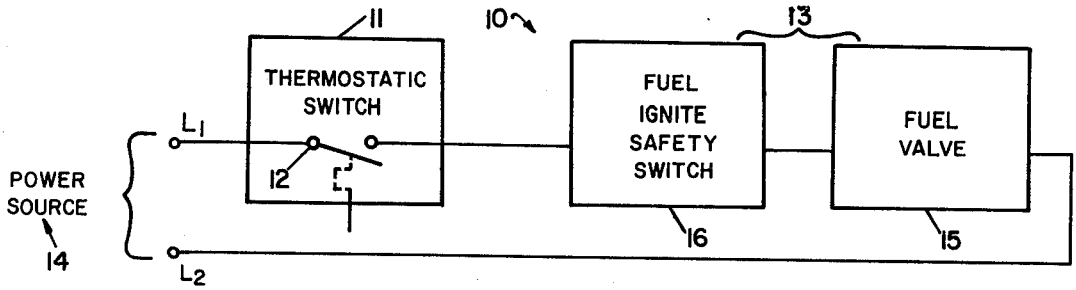
FIG. 1 PRIOR ART
FIG. 1 is a diagram of a conventional prior art fuel control system.

Referring now to the drawings, and FIG. 1 thereof, there is shown a prior art fuel control apparatus 10 in which a conventional thermostatic switch 11, having a pair of contacts 12 operable in response to environmental temperature within a predetermined temperature range, is provided in series circuit with a fuel control system 13 and a power source 14. The fuel control system 13 generally consists of a fuel valve 15 for controlling the flow of fuel in a fuel-fired heating system and a fuel ignite safety switch 16 is often employed in conjunction with the fuel valve 15. The fuel ignite safety switch 16 may take several forms. For example: in an oil-fired heating system, employing a spark ignition system (not shown), a photo electric device is often employed to indicate that the fuel has been ignited so fuel flow may continue. In the absence of a photoelectric device signal, the fuel valve 15 may not be energized and the system is shut down. Another fuel ignite safety switch often employed in gasfired heating systems is the use of the thermocouple element in a pilot flame (not shown), wherein the pilot flame would ignite the main fuel supply. In the absence of a pilot flame, a thermocouple signal is not present and thus the fuel system is shut down. The power source 14 employed in the prior art systems may involve line voltage such as 110 volt supply or some low voltage system, such as a 24 volt power supply for the circuit.

Figure 2:
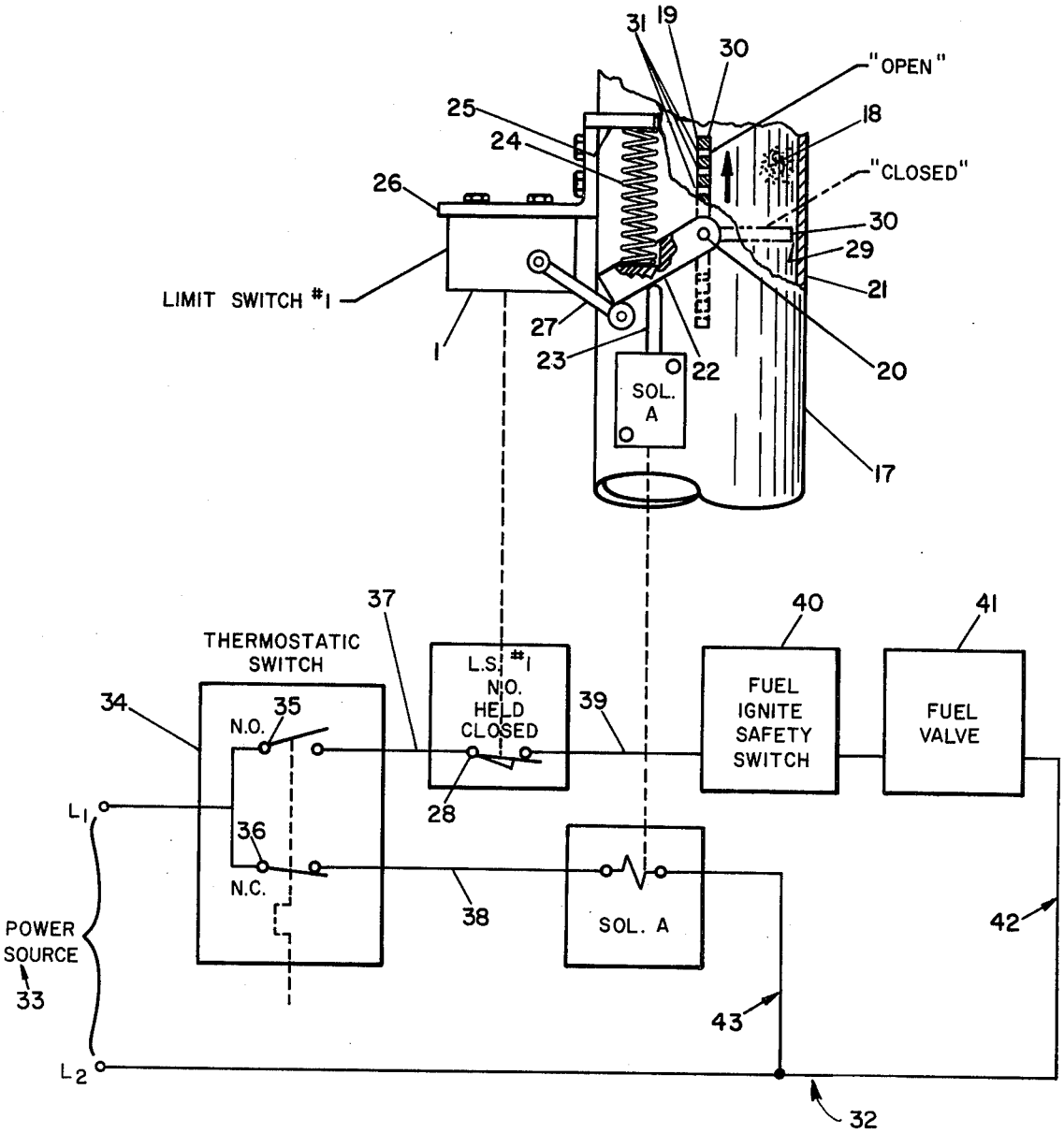
FIG. 2 is a diagramatic drawing of the apparatus and circuitry for an improved energy-conserving flue damper system.

FIG. 2 depicts a system for a fuel-fired heating apparatus (not shown), which utilizes a flue 17 for the removal of products of combustion 18 from the apparatus. A damper plate 19 is shown fixedly mounted on a pivot axle 20 pivotally received within the flue wall 21 wherein the damper plate 19 is movable from a first "open," position (shown in solid) to a second, "closed" position (shown in phantom). The axle 20 of the damper plate 19 is affixed with a transverse arm 22, and the arm 22 is contacted by a plunger 23 which is actuated by a solenoid "A" to drive the plate 19 from the "open" to the "closed" position. A biasing spring 24 is mounted in reaction against both the transverse arm 22 and a bracket 25 on the flue 17 so as to tend to bias the arm 22 and damper plate 19 to the "open" position in the absence of an energizing signal to the solenoid "A." A limit switch "1" is mounted to a bracket 26 on the flue 17, and the limit switch "1" has a trip arm operator 27 which may be contacted by the transverse arm 22 of the damper plate 19 when the plate 19 is in the "open" position. In this manner therefore, a pair of normally-open contacts 28 within the limit switch "1" are held closed when the damper plate 19 is in the "open" position.

The damper plate 19 is constructed so that when it is in the "closed" position, the exhaust flow path (in the direction of the arrow), will not be completely obstructed but, rather, a predetermined clearance 29 between the periphery 30 of the damper plate 19 and the wall 21 of the flue 17 exists and, further, a plurality of orifices 31 are provided through the damper plate 19 so that certain minimal products of combustion 18 may flow through the flue 17 and a draft may be induced to create a "chimney effect."

A circuit 32 is depicted, having a power source 33 with lines "L1" and "L2." A thermostatic switch 34, is provided, having a pair of normally-open contacts 35 and a pair of normally-closed contacts 36 which are operated in response to temperature within a predetermined temperature range. The contacts 35, 36 are connected to line "L1" and are alternately operable to provide mutually exclusive output lines 37, 38 from the contacts. The output line 37 from the normally-open contacts 35 is connected to the normally-open held-closed contacts 28 of the limit switch "1" and an output line 39 from the limit switch "1" is connected to a fuel ignite safety switch 40 and a fuel valve 41, all connected in series with line "L2" to establish a first series circuit 42 with the power source 33 for initiating a fuel flow.

The output lines 38 from the normally-closed contacts is connected to the solenoid "A" in series with line "L2," to establish a second series circuit 43 for closing the damper plate 19.

Thus, in operation, when the thermostatic switch 34 gives an output signal on the line 38 of the normally-closed contacts 36, the solenoid "A" will be energized and the damper plate 19 will be driven to the "closed" position. It may be seen, then, that both the normally-open contacts 35 of the thermostatic switch 34 and the normally-open contacts 28 of the limit switch "1" will be opened, inhibiting fuel supply when the damper plate 19 is closed.

When the thermostatic switch 34 closes the normally-open contacts 35 and opens the normally-closed contacts 36, the solenoid "A" will be de-energized, and a signal will be present on the normally-open contact 35 output line 37 through the now-closed limit switch contacts 28 to initiate fuel supply. In the event the biasing spring 24 fails to return the damper plate 19 to the "open" position, the limit switch "1" will have open contacts 28 and the fuel supply will be inhibited.

What is claimed is:

1. An energy-conserving control system for fuel-fired heating systems having a flue, flue damper, and fuel control means, comprising:

(a) a power source;

(b) a switch, having a pair of normally-closed contacts and a pair of normally-open contacts alternately operable by switch activating means;

(c) signal means for sensing a flue damper position; and (d) power means to operate said flue damper; wherein said power source, said signal means, said normally-opened contacts and said fuel control means are in a first series circuit and further wherein said power source, said normally closed contacts and said power means are in a second series circuit.

2. An improved flue damper, comprising:

(a) damper means, movable from an open position to a closed position;

(b) actuating means to move said damper means;

(c) biasing means tending to bias said damper means to said open position; and (d) signal means to sense said damper means position wherein said signal means is in a first electric circuit with a power source means to control a fuel source, and said actuating means is in a second electric circuit with a power source means, and said first and second circuits are activated by a common switching means so as to be mutually exclusive.

* * * * *